US009279242B2

(12) United States Patent
Alvarado

(10) Patent No.: US 9,279,242 B2
(45) Date of Patent: Mar. 8, 2016

(54) DRAIN GRATE SYSTEM AND METHOD

(71) Applicant: G2 Construction, Inc., Garden Grove, CA (US)

(72) Inventor: John Alvarado, Santa Ana, CA (US)

(73) Assignee: G2 Construction, Inc., Garden Grove, CA (US)

( * ) Notice: Subject to any disclaimer, the term of this patent is extended or adjusted under 35 U.S.C. 154(b) by 245 days.

(21) Appl. No.: 13/801,910

(22) Filed: Mar. 13, 2013

(65) Prior Publication Data

US 2014/0262996 A1 Sep. 18, 2014

(51) Int. Cl.
*E03F 5/06* (2006.01)
*E03F 5/04* (2006.01)
*E03F 5/046* (2006.01)

(52) U.S. Cl.
CPC ..... *E03F 5/0404* (2013.01); *E03F 5/046* (2013.01); *E03F 5/06* (2013.01)

(58) Field of Classification Search
CPC ..... E03F 5/0404; E03F 5/046; E03F 5/06; E03F 5/14
USPC ..... 210/131, 156, 162, 163, 170.03; 404/4, 404/5; 405/94, 95, 99
See application file for complete search history.

(56) References Cited

U.S. PATENT DOCUMENTS 248,559 A 10/1881 Jackson
440,067 A 11/1890 Smith
506,267 A 10/1893 Sefton
576,790 A 2/1897 O'Brien
1,066,316 A 7/1913 Piper
1,220,123 A 3/1917 Heybach
1,245,903 A 11/1917 Jackson
1,397,471 A * 11/1921 Walker ..... 210/131
1,711,674 A 7/1925 Egan
1,999,637 A 4/1935 Pettepher
3,838,706 A 10/1974 Klenk et al.
5,403,474 A 4/1995 Emery
5,954,952 A 9/1999 Strawser, Sr.
6,015,489 A 1/2000 Allen et al.
6,080,307 A 6/2000 Morris et al.
6,106,707 A 8/2000 Morris et al.
6,217,756 B1 4/2001 Martinez
6,299,764 B1 10/2001 White et al.
6,368,499 B1 4/2002 Sharpless
6,531,059 B1 3/2003 Morris et al.
6,726,402 B1 4/2004 Martinez
6,733,665 B1 5/2004 Khalil
6,821,053 B2 11/2004 Martinez
6,824,677 B2 11/2004 Martinez
6,869,523 B2 3/2005 Martinez
6,955,756 B2 10/2005 Fallon
6,972,088 B2 12/2005 Yehuda
7,234,894 B1 6/2007 Flury (Continued)

FOREIGN PATENT DOCUMENTS

DE 3121487 A1 12/1982

*Primary Examiner* — Christopher Upton
(74) *Attorney, Agent, or Firm* — Knobbe Martens Olson & Bear LLP

(57) ABSTRACT

A drain grate system can be installed in a curbside or storm drain to block the passage of debris while allowing liquid to flow into the drain. The drain grate system can open in response to a high flow rate to allow liquid and debris to flow into the drain. A locking mechanism can maintain the drain grate system in a closed and locked position and can unlock in response to a predetermined amount of force of a fluid flow.

11 Claims, 12 Drawing Sheets

(56) References Cited

U.S. PATENT DOCUMENTS

| | | | | |
|---|---|---|---|---|
| 7,238,279 | B2 | 7/2007 | Saurenman et al. | |
| 7,467,911 | B2 | 12/2008 | Flury | |
| 7,491,338 | B2 | 2/2009 | Nino | |
| 7,951,291 | B2 | 5/2011 | Nino | |
| 2003/0136717 | A1 | 7/2003 | Tseng | |
| 2009/0236293 | A1* | 9/2009 | Alvarado | 210/163 |
| 2010/0147752 | A1 | 6/2010 | Jarvis, Jr. et al. | |

* cited by examiner

DRAIN GRATE SYSTEM AND METHOD

BACKGROUND OF THE INVENTION

1. Field of the Invention

The application relates generally to the field of street drainage, more specifically to drain grates that are movable in response to water flow therethrough.

2. Description of the Related Art

Road drainage systems such as curb-integrated storm drains are common throughout urban and suburban areas. In these areas, litter, trash, and other debris such as plant trimmings, leaves, and bark may accumulate on the roadway and be blown or washed towards the drains. In dry seasons, when the precipitation is not sufficient to flush the drain systems regularly, the debris may accumulate in the drains.

In a subsequent rainy season, the accumulated debris may clog the drain, leading to greatly reduced drain capacity and ultimately road flooding at or near the drain opening. Additionally, the flow of water through a drain that is clogged or partially clogged with debris is likely to result in the release of some or all of the debris into the flow of water continuing downstream from the drain. Often this trash, plant material, and other debris flows into oceans, creeks, rivers, and streams. To reduce the incidence of flooding, municipalities often expend considerable resources and employee time cleaning accumulated debris out of drains and drain basins to reduce the risks of roadway flooding and pollution.

Drain grates, positioned at or in a drain opening, have been developed to block the entry of debris into the drain system. This allows the debris to be removed by a street sweeper or by other conventional roadway cleaning techniques. To block the entry of debris while maintaining optimum drainage capacity, the grate should be removable from the drain opening when the flow of water through the drain reaches and exceeds a predetermined rate.

In dry and low water flow situations, the drain grate would remain closed in the drain opening, permitting passage of water through the grate, but blocking debris too large to fit through the grate. In higher water flow situations, an actuator connected to the drain grate would cause the drain grate to move away from the drain opening, thus increasing the flow capacity through the drain. The actuator of these systems typically comprised a container having a drain opening. These movable drain grates, while desirably preventing debris accumulation during relatively dry weather and allowing higher flow capacity during high water flow periods, remain prone to flooding in certain high water flow periods. In certain instances, enough water accumulates in the basin portion of the drain that the actuator floats in the accumulated water. Since the actuator is operatively connected to the drain grate, the flotation of the actuator closes the drain grate, thereby reducing the flow capacity of the drain opening. Thus, flow through the drain is reduced during instances (high water flow) when increased flow capacity is most desired.

Furthermore, some of the attempted solutions require a relatively deep basin to operate effectively. The depth of a roadway drain can be dependent on its distance from a drainage system outlet such as a stream, river, lake, or ocean, such that the drainage system floor has a slope to provide gravity feed from all of the individual drains to the endpoint without pooling. Thus, actuators in some of the previous drain grate actuation systems could not be sized to fit a relatively shallow drain basin. Additionally, various cities and counties have drafted rules and regulations limiting the size of acceptable drain grate systems such that many of the previous designs are no longer acceptable.

In light of the shortcomings of the prior art noted above, there is a need for a drain grate system that prevents the accumulation of debris in the drainage system during dry weather, that opens the grate for increased capacity in response to relatively high water flow conditions, such as a storm water event, that remains open despite water accumulation in the drain, and that meets the needs of various city and county regulations.

SUMMARY OF THE INVENTION

According to some embodiments, a drain grate system comprises a grate, a force plate and an energy plate. The grate can be configured to filter flows of liquid therethrough, having a closed position and an open position. The force plate can lock and unlock the grate in the closed position and can be pivotally connected to the grate, creating a moment arm. The moment arm can extend along the grate when the grate is in the closed position. The energy plate can be attached to the grate, for directing a flow of liquid against the force plate. The drain grate system can be configured so that the flow of liquid acting upon the moment arm of the force plate causes an end of the force plate to rotate away from the grate about the pivot attached to the grate, thereby unlocking the grate and allowing the grate to move to an open position.

In certain embodiments the force plate and energy plate create lift to help open the grate. Depending on the configuration of the embodiment, the force plate can rotate about a vertical axis.

The drain grate system may further comprise an arm fixed in relationship to a drain opening and a latch configured to engage a recess in the arm to lock the grate in the closed position. The latch can be pivotally connected to the grate. It may also further comprise a second force plate configured to act on the latch to unlock the drain grate system, wherein a flow of liquid acting on either or both of the force plates can unlock the drain grate system.

In some embodiments, a drain grate system can be positioned at a drain to control fluid flow into the drain. The drain grate system can comprise a frame configured to be fixed in position with relation to a drain, at least one axle, a grate, and a locking mechanism. The grate can have a curved top and be pivotally coupled to the frame through the at least one axle at the curved top. The grate can be configured to filter flows of liquid therethrough and to pivot between a closed position and an open position. The locking mechanism can be biased to lock the grate in the closed position. The locking mechanism can comprise a force plate coupled to the grate and configured such that a flow of liquid acting upon the force plate causes a portion of the force plate to move away from the grate thereby unlocking the grate and allowing the grate to move to the open position.

According to some embodiments, a storm drain grate system can comprise a grate configured to filter flows of liquid therethrough and to pivot between a closed position and an open position, and a locking mechanism. The locking mechanism can have a locked position and an unlocked position. The locking mechanism can be biased to the locked position when the grate is in the closed position. The locking mechanism can comprise a fixed arm comprising a recess, a latch member, and a force plate. The latch member can have a first portion engaged with the fixed arm when the locking mechanism is in a locked position, the latch member further having a second portion and the latch member configured to rotate. The force plate can be configured such that a flow of liquid acting upon the force plate causes the force plate to rotate, the second portion of the latch member engaged with the force plate and configured such that rotation of the force plate causes rotation of the latch member to thereby disengage from the fixed arm and to move the locking mechanism to the unlocked position. The latch member can be configured such that rotation of the latch member between the locked and unlocked positions causes the second portion of the latch member to move a first distance less than 75% of a second distance experienced by the first portion of the latch member.

DETAILED DESCRIPTION OF THE PREFERRED EMBODIMENTS

Figure 1:
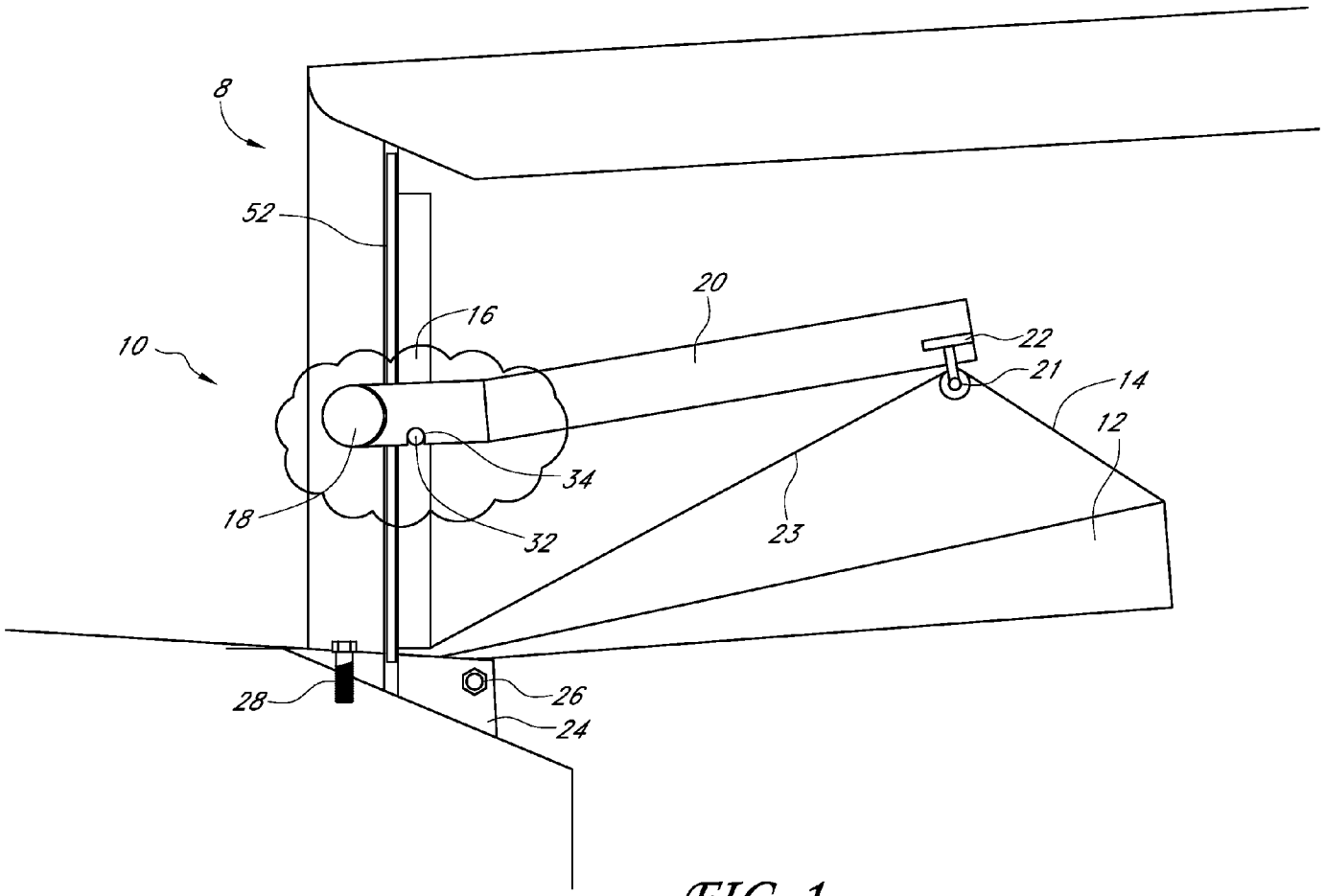
FIG. 1 illustrates a side view of an embodiment of a drain grate system.

With reference to FIG. 1, in certain embodiments, a drain grate system 10 is provided comprising a grate 52 connected by a hinge to an opening of a drain 8, and a grate actuator 12 operatively coupled to the grate. The grate 52 is configured to allow the flow of a liquid therethrough and to block passage of debris therethrough. The grate actuator 12 is operatively coupled to the grate 52 such that for small flow rates of liquid through the grate 52, the position of the actuator 12 does not cause the grate 52 to open and for larger flow rates of liquid through the grate 52, the actuator 12 causes the grate 52 to open.

The drain 8 can be any of the various types of drains, such as storm drains, curb basins, catch basins, etc. The distance from the drain opening to the back of the drain (not shown) varies and can be, for example, between 6" and 24" for smaller drains. Other drains can be much longer, for example, 3' to 6'. The size of the drain opening can also vary. Examples include openings from 4" to 18" tall and 2' to 50' wide. Typical widths for drain openings include: 3.5', 7', 10', 14', 21', 28', 35' and 50'.

The flow of liquid, such as water into a drain can vary greatly and can depend on the flow of the liquid but also the size of the drain. A low flow could be equal to a trickle of water or to the flow of a common garden hose, which can average about 10 gals/min. A high rate of flow caused by a downpour of rain can be equal to, for example, a rate of flow of 2 to 3 $ft^3/s$. A common high rate of flow used by the county of Los Angeles, Calif. to test drain grate systems is 5 $ft^3/s$ (2244 gals/min). Other high rates of flow could be lower or higher than the rates given.

FIG. 1 shows an embodiment of a drain grate system 10 installed in a curbside basin or storm drain 8. As seen in FIG. 1 the drain grate system 10 can comprise a drain grate 52, an actuator 12, and an actuation mechanism 14. As discussed further with respect to FIGS. 3 and 4, some embodiments of the drain grate system can also comprise a locking mechanism 16.

As can be seen in FIG. 1, an actuator 12 can be coupled to the drain grate 52 with an actuation mechanism 14. In some embodiments, the actuator 12 can comprise a water tray and the actuation mechanism 14 can comprise a cable 23. The cable 23 can be routed from the actuator 12 through a routing device such as a pulley 21 and can then be connected to the grate 52.

The drain grate system 10 can work as follows. In some embodiments, a flow of liquid, such as water can flow through and/or around the grate 52 and onto the actuator 12. When the amount of liquid on the actuator 12 has reached a certain point, the weight of the liquid can cause the actuator 12 to move downward. As the cable 23 is connected to both the grate 52 and the actuator 12, the downward movement can cause the cable 23 to pull on and thereby open the grate 52.

With continued reference to FIG. 1, in some embodiments, a pulley 21 can be mounted on an arm 20 extending from a fixed protective bar 18, which extends across the curbside opening. In some embodiments, the arm 20 can have a slot 22 therein to receive the pulley 21. Thus, advantageously, the pulley 21 need not be mounted to a wall or ceiling of the basin itself, which can be labor-intensive and unfeasible in certain installations having relatively small basins. Rather, the pulley 21, and thus the actuation mechanism 14 can be installed from curbside, allowing a relatively fast and easy installation of the routing device.

Still referring to FIG. 1, the actuator 12 can be pivotally coupled to a foot 24 of the drain grate system 10 with a pivotable fastener 26 such that flow of water through the drain grate 10 pivots the actuator 12. The foot 24 can be coupled to the curbside basin, such as with a fastening bolt 28. Thus, advantageously the installation of the actuator 12 can also be accomplished from curbside as the fastening bolt 28 can be positioned relatively close to the street side of the drain.

Figure 2:
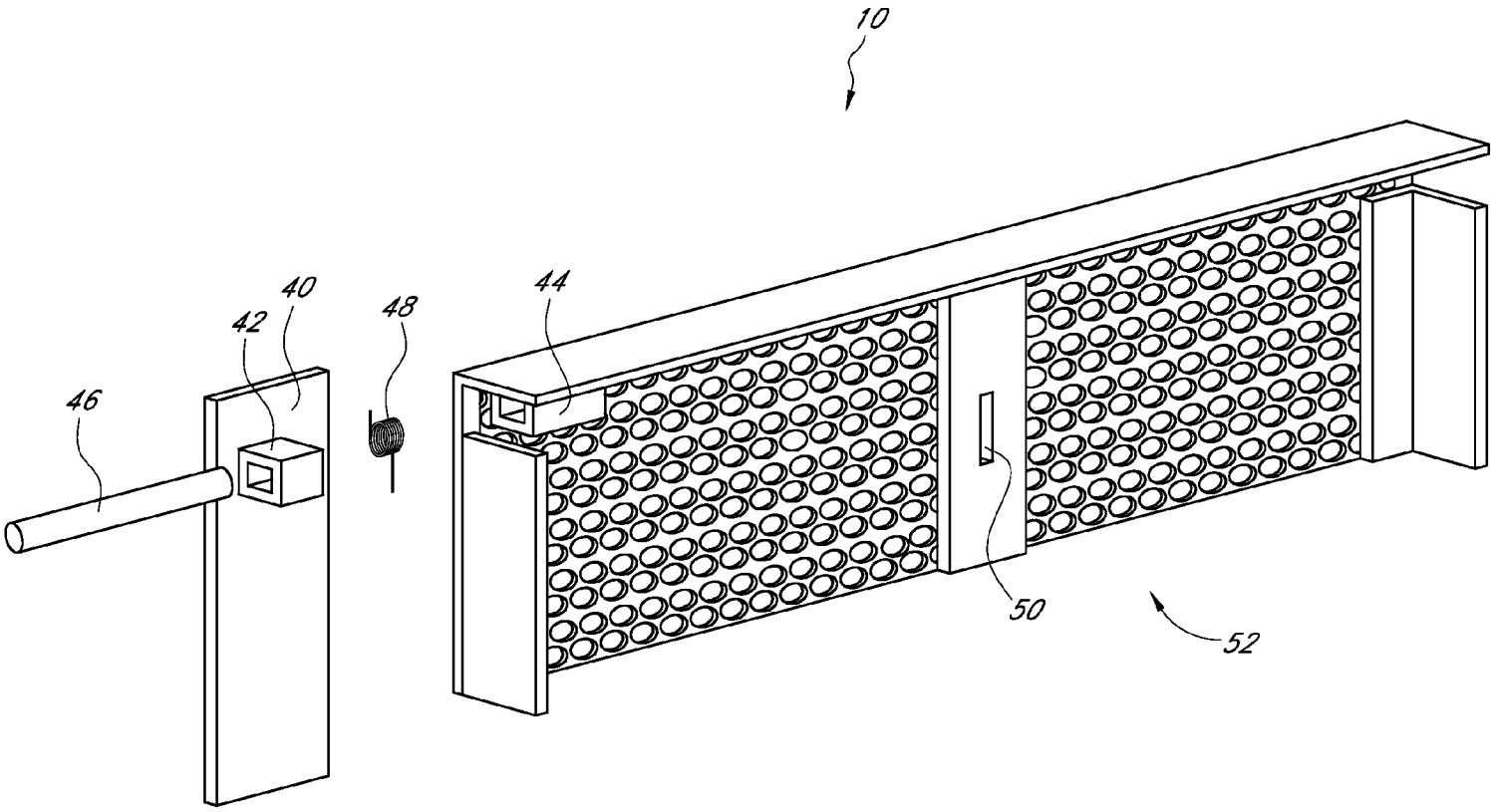
FIG. 2 shows an exploded rear view of part of the drain grate system of FIG. 1.

Now turning to FIG. 2, an exploded rear view of some embodiments of a drain grate system 10 is shown. In the illustrated embodiment, the drain grate 10 includes a frame and a mesh surface spanning the frame. The mesh surface can comprise, for example, a metal screen or a wire surface. The holes in the mesh surface can be configured to allow liquid to flow through the surface while not allowing debris of a certain size and shape to pass through the surface. The drain grate 10 can be pivotally coupled to one or more legs 40, which can vertically span the curbside opening. In some embodiments, a foot 24, as described above with reference to FIG. 1, can be coupled to each leg 40. In the illustrated embodiment, the drain grate 10 is pivotally coupled to the leg 40 with a hinge arrangement comprising an axle 46 extending through passageways 42, 44 in the leg 40 and the drain grate 52. This hinge arrangement can be biased such that the drain grate tends to remain in the closed position. A spring 48 or other biasing member can be used to bias the drain grate 10 in the closed position. The weight of the drain grate 52 can also be used to bias the drain grate system 10 in the closed position without the use of a spring or biasing member. As illustrated, the drain grate 52 can include a slot 50. The slot 50 can allow the arm 20 to pass through the drain grate 52. The arm 20 of some embodiments is attached to the fixed protective bar 18. In some embodiments the arm 20 is attached to a leg 40. Relatedly, some embodiments can have more than one fixed protective bar 18.

Figure 3:
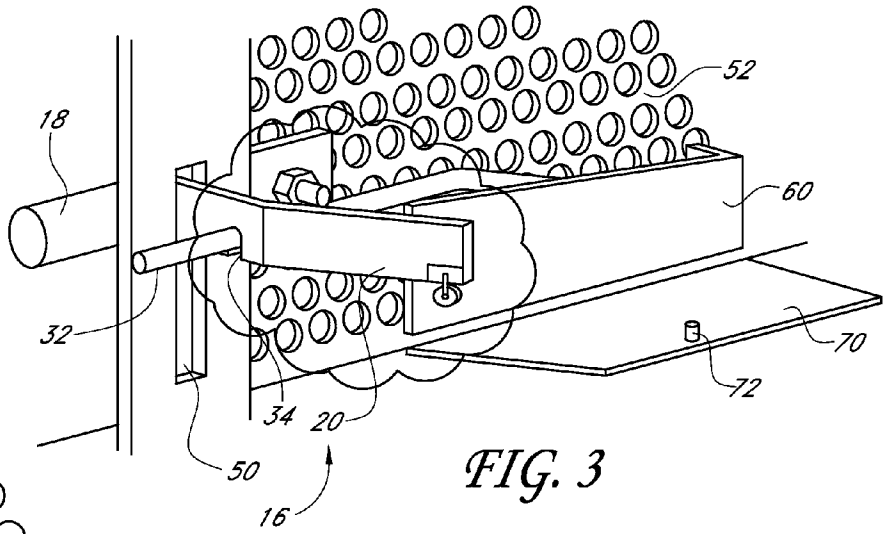
FIG. 3 illustrates a perspective view of a self locking mechanism for a drain grate system.
Figure 4:
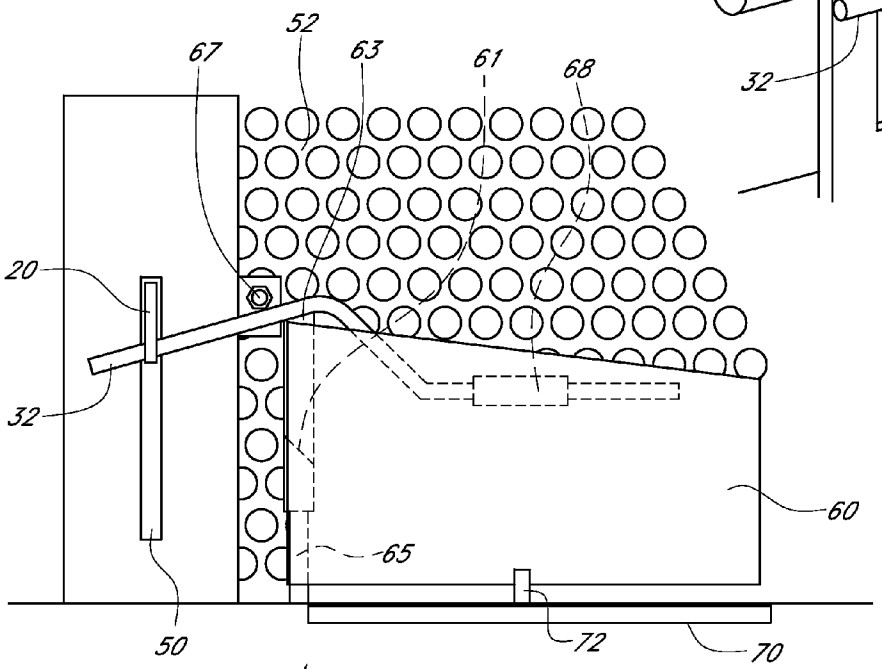
FIG. 4 illustrates a rear view of the self locking mechanism of FIG. 3.

With reference to FIGS. 3 and 4, a locking mechanism 16 for a drain grate system 10 is shown. The locking mechanism 16 can prevent the grate 52 from opening unless there is a sufficient flow of liquid therethrough. In some embodiments, the locking mechanism 16 can include a force plate 60 configured to move responsive to a flow of liquid through the drain grate 52. The locking mechanism 16 can also include a latch member 32 having a first or locked position in which the latch member 32 prevents movement of the drain grate 52 with respect to the arm 20 and a second or unlocked position in which the latch member 32 allows relative movement of the drain grate 52 with respect to the arm 20. In some embodiments, the arm 20 can include a recess 34 formed therein to receive the latch member 32 in the locked position and to prevent movement of the drain grate 52 relative to the arm 20.

With continued reference to FIGS. 3 and 4, the functioning of some embodiments of a locking mechanism 16 will be described. Liquid, such as water, flowing into the drain 8 through the grate 52 can come into contact with a force plate 60. When the flow of water reaches a predetermined pressure against the force plate 60, the force plate 60 can be forced to pivot away from the grate 52. In some embodiments, the force plate 60 can pivot at a cam interface 61 defined by a first or upper interface surface and a second or lower interface surface. The force plate 60 can act as a moment arm that extends along the grate 52. The length and size of the force plate 60, among other features, can help determine the amount of force of a flow of liquid needed to rotate the force plate 60. In some embodiments, the force plate 60 extends along a substantially length of the grate 52. In some embodiments, one size of force plate 60 is used independent of the length of the grate 52 or drain opening.

A rod 65 can be attached to the grate 52 and to one half of the cam interface 61. The force plate 60 can be attached to the other half of the cam interface 61 and can rotate about the rod 65. As the force plate 60 rotates about the rod 65, the two halves of the cam interface 61 work together to raise the force plate 60 along the axis of the rod 65. Thus, in some embodiments, the lock mechanism 16 can include a cam interface 61 such that the pivoting motion of the force plate 60 is accompanied by vertical displacement of the force plate 60. In some embodiments the cam interface 61 can be at an angle of approximately 45° relative to the horizontal. The angle can be more or less aggressive depending on the desired vertical displacement. For example, the angle can be between 15° and 75° and more preferably between 30° and 60°. This raising up or vertical displacement of the force plate 60 can be used to unlock the locking mechanism 16.

In some embodiments, a latch member 32 can be rotated by the raising up of the force plate 60 to unlock the locking mechanism 16. As seen in FIGS. 3 and 4, a latch member 32 is engaged in a recess 34 of the arm 20. The latch member 32 can be pivotally coupled to the drain grate 52 such as with a pivot 67. The pivot 67 in some embodiments can be a flange defining an opening mounted on a pivot rod. Raising the force plate 60 can engage the force plate 60 with the latch member 32, causing the latch member 32 to rotate about the pivot 67 and disengage the recess 34. Once the latch member 32 is released from the arm 20, the grate 52 can be allowed to pivot, thus allowing the drain grate system 10 to move away from the closed position and to an open position.

In some embodiments, the force plate 60 can engage the latch member 32 at a second cam interface 63 defined by a first or upper interface surface and a second or lower interface surface. This second cam interface 63 can further increase the rate at which the latch member 32 is forced to rotate and to disengage the recess 34. Thus, in the illustrated embodiment, pivotal rotation of the force plate 60 responsive to liquid flow through the grate 52 can cause vertical displacement of a portion of the latch member 32 through a dual cam interface 61,63. In other embodiments, a single cam interface can convert rotation of the actuation plate 60 into vertical displacement of a portion of the latch member 32 to unlock the locking mechanism 16.

In some embodiments, the second cam interface 63 is between 10° to 12°. It is contemplated that in other embodiments of locking mechanism 16, other angles than those mentioned previously, can be used for the cam interface 61 and/or the second cam interface 63. In addition, in some embodiments the cam interface(s) can be angled in the other direction from that shown, such that rotation of the force plate 60 lowers the force plate 60 and/or lowers a portion of the latch member 32. As shown, the force plate 60 rotates about a substantially vertical axis at rod 65. In other embodiments, the force plate 60 can rotate about a substantially horizontal axis or about a diagonal axis.

The lock mechanism 16 can desirably have a self-locking mechanism. For example, the lock mechanism 16 can include a counterweight 68 disposed on the latch member 32 opposite an end of the latch member that interfaces with the arm 20 such that the latch member 32 tends to remain in the locked position. In some embodiments, the counterweight 68 can be on the same end as the portion of the latch member 32 that interfaces with the arm 20; for example, where the latch member 32 interfaces at a top of the arm 20 instead of at the bottom as is show in the figures.

After the latch member 32 is disengaged from the recess 34 in the arm 20, the latch member 32 can track along the arm 20 as the grate 52 opens. The arm 20 can be straight or curved upward, downward, to the side or some combination of these and other configurations. The arm 20 and latch member 32 can be used to limit the rotation of the grate 52. For example, the latch member 32 can have a bent end configured to catch the arm 20 and not allow the latch member to move along the arm 20 any farther. This can stop the rotation of the grate 52, thus preventing the grate 52 from opening further.

Other variations of the force plate 60 and the latch member 32 are also contemplated. For example, the force plate 60 and latch member 32 could be directly connected, or the force plate 60 could push the latch member 32 away from the grate 52 instead of up or down, or the force plate 60 could be angled to push the latch member 32 up or down. The latch member 32 could be on the other side of the force plate 60 away from the grate 52. The latch member 32 could also be bent or rotated or otherwise configured in ways other than those shown in the figures.

In some embodiments, the drain grate system 10 can comprise an energy plate 70. The energy plate 70 can be located proximate to the force plate 60 and can be configured to direct a flow of liquid at the force plate 60. In the illustrated embodiment, the energy plate 70 is fixed with respect to the grate 52. As can be seen in FIG. 3, in some embodiments the energy plate 70 is located under and perpendicular to the force plate 60. As liquid flows through the grate 52, it can force the force plate 60 to rotate and unlock the locking mechanism. As the force plate 60 rotates, some of the liquid can pass under the force plate 60. Thus, the force plate 60 can lose some of the energy derived from the flow of the liquid. This can result in relocking the drain grate system 10. The energy plate 70 can direct more of the liquid to press against the force plate 60. This can help the drain grate system 10 to remain open once the desired pressure has been reached and stay open while this water pressure is being experienced by the force plate 60.

The energy plate 70 of some embodiments is configured to direct fluid flow towards the force plate 60 throughout the entire rotation of the force plate 60. In some embodiments, the energy plate 70 directs fluid flow towards the force plate 60 through an initial segment of the rotation of the force plate 60.

As can be seen from the above discussion, the force plate 60 and locking mechanism 16 are fundamentally different from actuation and locking mechanisms of prior art designs. This is because the force plate is actuated by the force of the flowing liquid instead of the accumulated weight of the liquid in a basin or tray. As shown, the locking mechanism 16 and force plate 60 can be used with an actuator 12 to open and rotate the grate 52 but this is not necessary. As will be shown hereafter, the locking mechanism 16 and force plate 60 can also be used without any other actuation means such as the actuator 12. The force of a flow of liquid and the force plate 60 can be used to both unlock the locking mechanism 16 and open/rotate the grate 52.

In some embodiments the drain grate system 10 can comprise a restraint or stop 72. The restraint 72 can restrain the force plate 60 from moving past a certain point. This can help direct more liquid against the force plate 60 and keep the drain grate system 10 open. For example, without the restraint 72, under certain conditions, such as high liquid flows, the force plate 60 could be rotated until it is perpendicular to the grate 52. In this position, the resistance between the drain grate system 10 and the flowing water is decreased which can tend to close the drain grate system 10 or move the grate 52 towards the closed position. But this is undesirable as it is desirable for the drain grate system 10 to remain open at times of high liquid flow. The restraint 72 can allow the force plate 60 to open to a certain degree but not to exceed that amount. This can maintain the resistance between the drain grate system 10 and the flowing liquid and can therefore help to ensure that the drain grate system 10 is maintained in an open position.

The force plate 60, more particularly with the restraint 72, though this is not required, can act like a wing of an airplane or the hull of a ship to create and increase lift between the drain grate system 10 and a flow of liquid. High liquid flow flowing against the force plate 60 can create a high pressure zone at this interface, while the pressure behind the force plate 60 remains at a lower ambient pressure. Thus, lift is created by this difference in pressures across the force plate 60 much like an airplane wing. The restraint 72 helps to maintain the position of the force plate 60 to help ensure that there is a difference in pressure between the front and the back of the force plate 60, thus ensuring that the grate 52 experiences lift as long as there are high fluid flows creating high pressure in front of the force plate 60.

The restraint 72 of some embodiments comprises a peg attached to the energy plate 70 as can be seen in FIGS. 3 and 4. In this embodiment, the force plate 60 can rotate until it contacts the peg. Thus, the peg limits the rotation of the force plate 60 to help maintain a balance between the force of the liquid against the drain grate system 10 and the force of the drain grate system against the flow of liquid.

Some embodiments can comprise multiple restraints 72. Another example of a restraint 72 includes a limiting arm. The limiting arm can be attached to one of the many different parts of the drain grate system 10 or the basin 8. For example, the limiting arm can be attached to one of the force plate 60, the arm 20, the grate 52, etc.

Now turning to FIGS. 5-8, one embodiment of a drain grate system 10' is shown. Numerical reference to components is the same as in the previously described arrangement, except that a prime symbol (') has been added to the reference. Where such references occur, it is to be understood that the components are the same or substantially similar to previously-described components.

Figure 5:
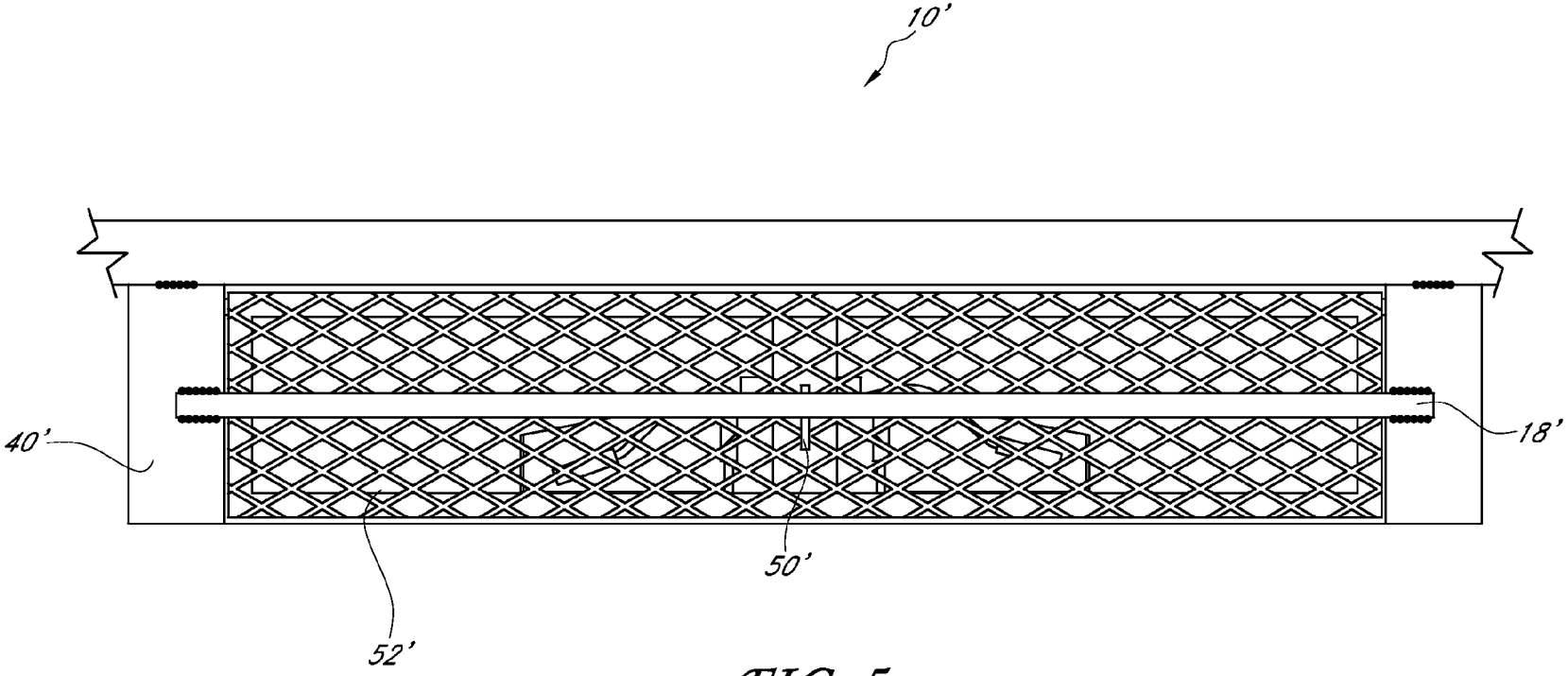
FIG. 5 illustrates a front view of another embodiment of a drain grate system.

FIG. 5 is a front view of a drain grate system 10'. Components shown include a fixed protective bar 18', a grate 52', legs 40' and a slot 50'. The drain grate system 10' can include an outer frame that may include the fixed protective bar 18' and legs 40'. In some embodiments the outer frame may also include a top plate such as that shown. In some embodiments, the drain grate system 10' can comprise more than one fixed protective bar 18'. In some embodiments, the components shown can be arranged in different relationships than those illustrated. The drain grate system 10' is shown in a closed position. In this position, liquid can flow through the drain grate system 10' but debris of a certain size and shape will not be able to pass through the holes in the grate 52'.

Figure 5A:
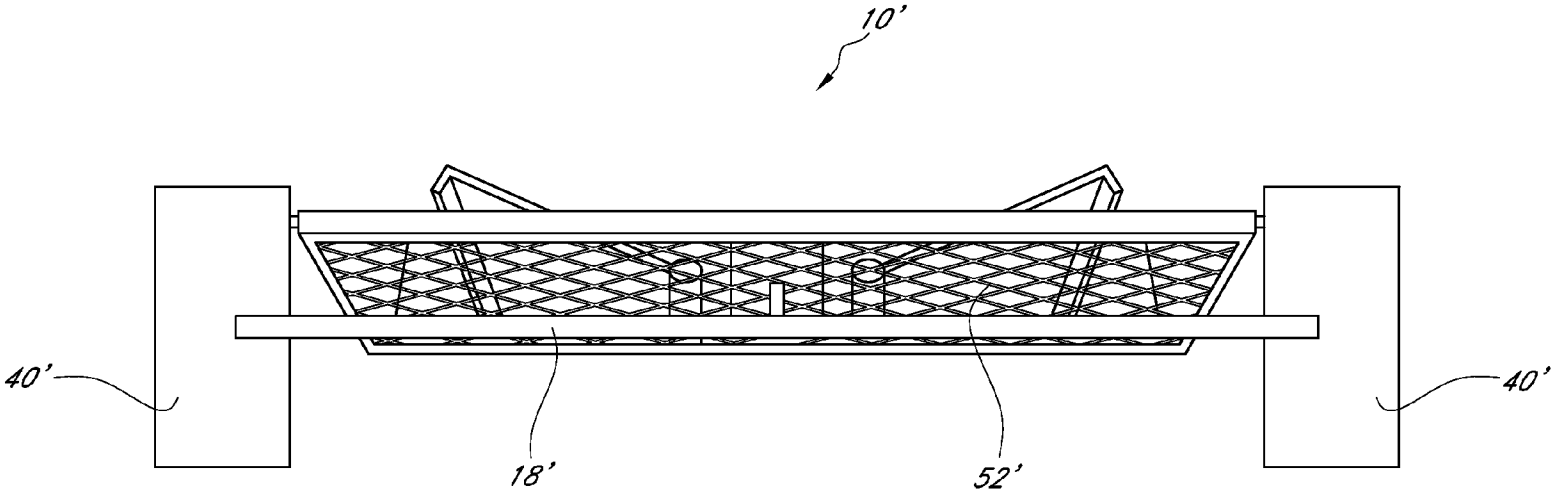
FIG. 5A shows a front view of the drain grate system of FIG. 5 in an open position.

FIG. 5A shows the drain grate system 10' in an open position. As shown, the grate 52' has been rotated so that liquid can pass through and under the grate 52' and debris can pass under the grate 52'. This can allow high flows of liquid to enter a drain while ensuring that debris does not enter at a time other than times of high liquid flow.

Figure 6:
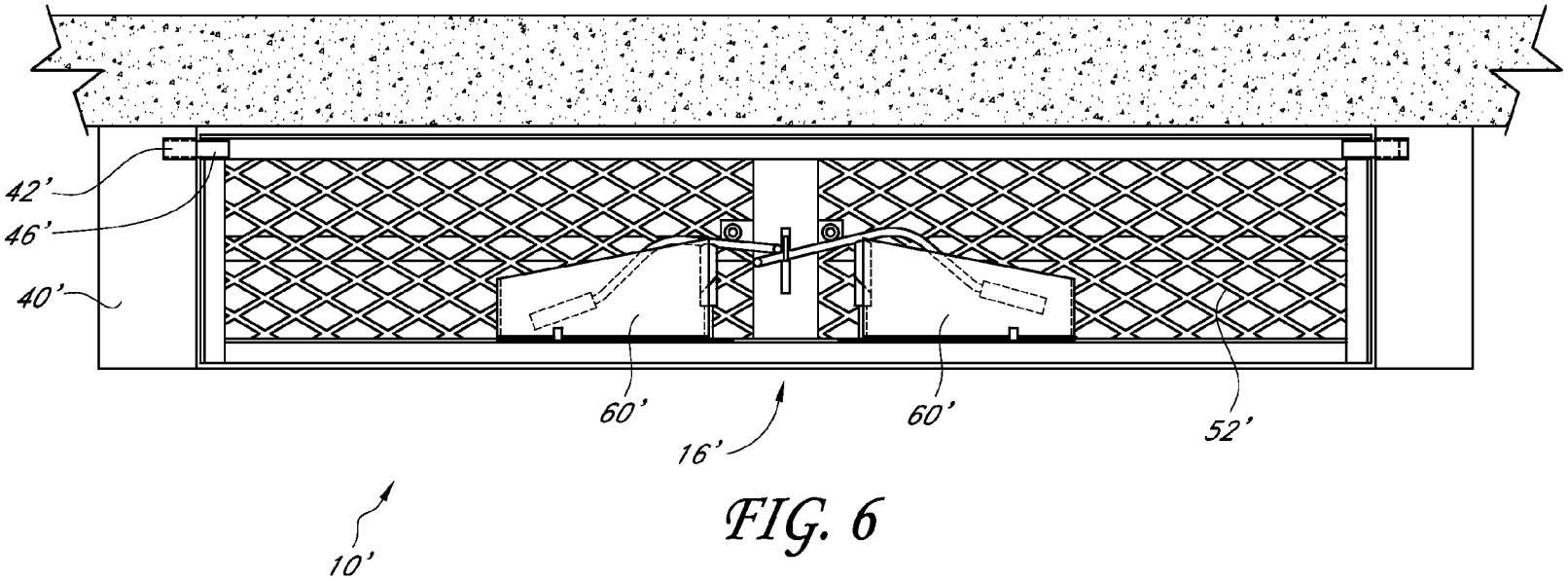
FIG. 6 shows a rear view of the drain grate system of FIG. 5.

A rear view of the drain grate system 10' is illustrated in FIG. 6. The drain grate system 10' can comprise a locking mechanism 16' with two force plates 60'. The drain grate system 10' can have a grate 52' that opens and closes and is connected to the legs 40' with axle 46' and passageway 42'. This can allow the grate 52' to pivot about the axis of the axle 46'.

Figure 7:
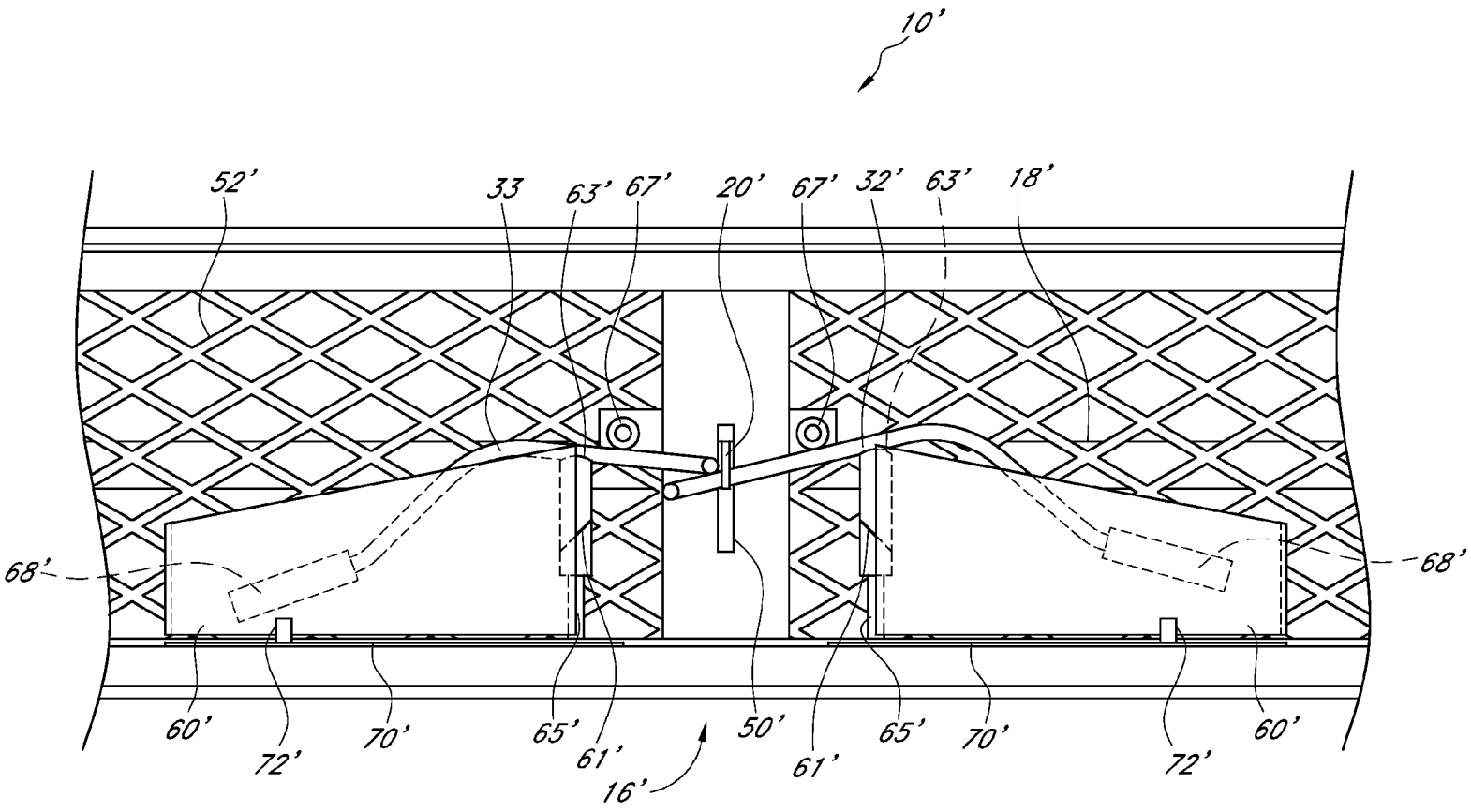
FIG. 7 is a rear detail view of the drain grate system of FIG. 5 showing a self locking mechanism.
Figure 8:
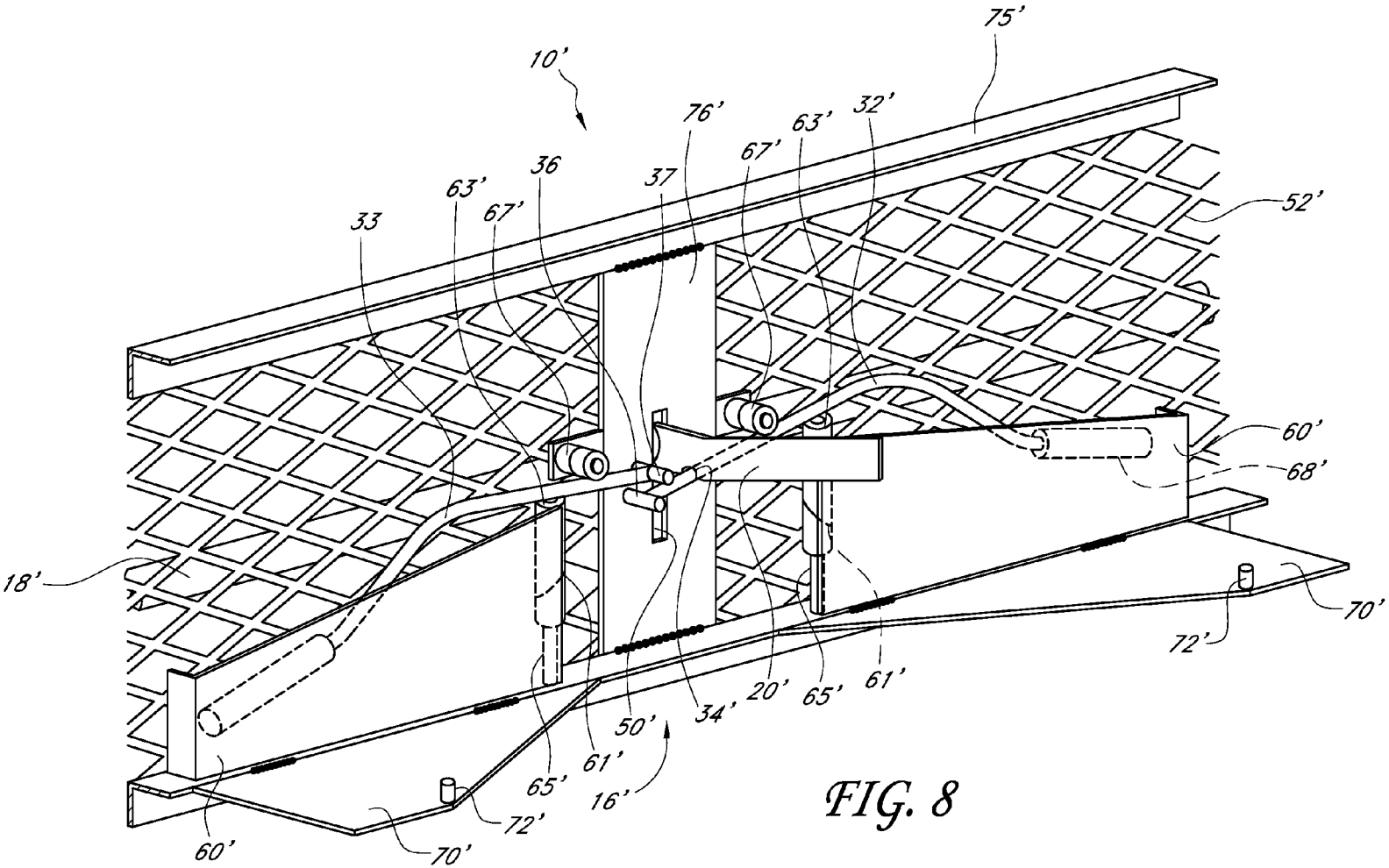
FIG. 8 illustrates a perspective rear detail view of a self locking mechanism of the drain grate system of FIG. 5.

A locking mechanism 16' will now be discussed with reference to FIGS. 7 and 8. A locking mechanism 16' can utilize two force plates 60'. In some embodiments with two force plates 60', each force plate 60' is on opposite sides of the arm 20'. Such a configuration is duly suited to handle typical rain water flows on city streets and other situations.

City streets are often made with either a high center or at a slight angle so that one side is higher than the other. Gutters can be formed along the sides of the street. This configuration allows liquid, such as rain water to flow off of the street and into the gutter. The gutter can then be configured to direct the liquid to a drain and thereby into a sewer or waterway system. Because liquid often flows along the gutter into the drain there are many situations where the liquid flows at an angle to the face of the grate 52'.

Advantageously, the two force plates 60' can be configured to rotate away from the grate 52' in opposite rotational directions, i.e. one to rotate to the right and one to rotate to the left. This can allow the locking mechanism 16' to work well with liquid flows coming from different directions and addressing the drain grate system 10' from different angles. For example, liquid flowing substantially perpendicular to the face of the grate 52' can interact with either or both force plates 60' to unlock the locking mechanism 16'. As another example, liquid flowing at an angle to the face of the grate 52' can efficiently act against the particular force plate 60' that after some initial rotation becomes perpendicular to the flow of the liquid. As high flows of liquid are likely to come from multiple angles and because common city gutter systems are configured to flow liquid into the drain from the side, a drain grate system 10' with a locking mechanism 16' is configured to quickly adapt to multiple situations where other prior art drain grate systems are more likely to be less responsive and to take more time to open in response to high liquid flows. Conveniently, the two force plates 60' can be configured such that each force plate 60' rotates in the direction from which flow is likely to come, i.e. the left (with FIG. 6 as the reference) force plate 60' rotates to the left and is more responsive to flow from the left than the right force plate 60', while the right force plate 60' rotates to the right and is more responsive to flow from the right than the left force plate 60'.

A locking mechanism 16' with two force plates 60' can function in the same or substantially the same way as previously described with one force plate 60. Alternatively, the two force plates 60' of the locking mechanism 16' can be linked so that only one needs to be acted upon to unlock the locking mechanism 16' and thereby allow the drain grate system 10' to open. In some embodiments, a latch member 32' can be acted upon by either force plate 60'. In some embodiments, the locking mechanism 16' has a latch member 32' and a push member 33. The push member 33 can be rotated by a force plate 60' as previously described with regard to the latch member 32 but instead of engaging the arm 20', the push member 33 can engage the latch member 32, pushing the latch member out of engagement with the recess 34' and allowing the drain grate system 10' to open.

In some embodiments, either or both of the latch member 32' and the push member 33' can have an engagement surface 36, 37. The engagement surface(s) 36, 37 can be configured to engage either the other member 32' or 33' or the other engagement surface 36 or 37. In some embodiments, the engagement surface 36, 37 is defined by a knob at the end of the latch member 32' and/or the push member 33'. The knob increases the surface area of the member available to contact by the other member to ensure proper contact is made between the members 32', 33'. An engagement surface 36 defined by the knob on the latch member 32' can also be used to limit how much the grate 52' is able to open. As the grate 52' opens, the latch member 32' tracks along the length of the arm 20'. When the knob 36 reaches the arm 20' continuing movement of the latch member is halted and the grate 52' is prevented from opening further.

In some embodiments, the slot 50' can be used to limit the rotation of the grate 52'. The length of the slot 50' and the length of the arm 20' can determine whether or not the slot 50' and arm 20' engage each other. In some embodiments, the slot 50' is sufficiently long so as not to engage the arm 20'. In some embodiments, the slot 50' is configured to allow the grate 52' to open to a set point. In some embodiments, the slot 50' is sufficiently long to allow some other part of the drain grate system 10' to control and/or limit the opening of the grate 52'.

Now turning to FIGS. 9-12, additional embodiments of drain grate systems 10" are shown. Numerical reference to components are the same as in the previously described arrangement, except that a double prime symbol (") or triple prime symbol (''') has been added to the reference. Where such references occur, it is to be understood that the components are similar to previously-described components but also include additional improvements as described herein.

The embodiments illustrated in FIGS. 9-12 offer several improvements over existing drain grate systems. The drain grate system 10" described herein comprises a high efficiency system, which when compared to previous drain grate systems, is less expensive to manufacture, easier to install, and during a storm water event is both more responsive to opening and capable of flowing more water.

Figure 9:
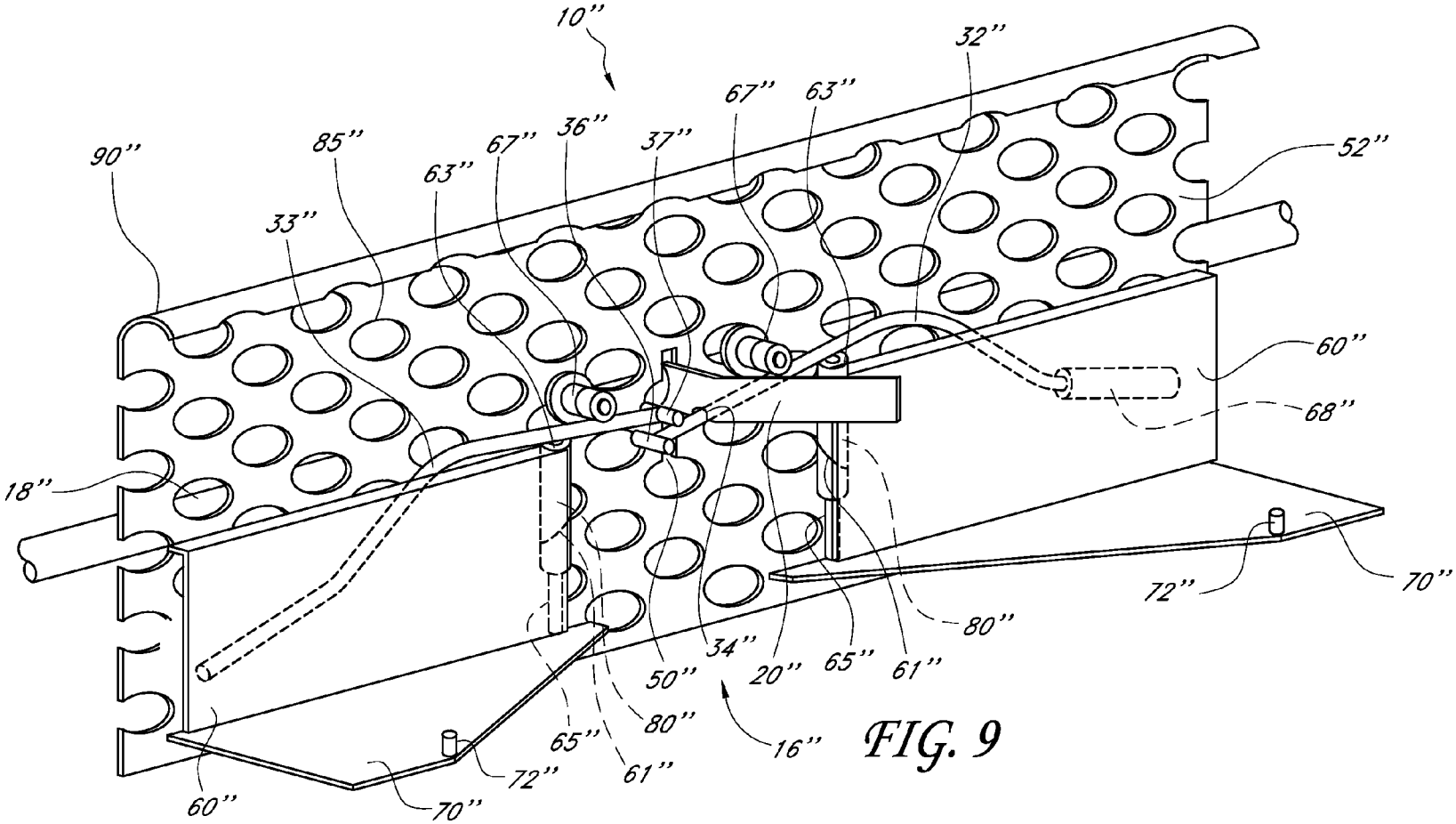
FIG. 9 illustrates a perspective rear detail view of a self locking mechanism of another embodiment of a drain grate system.

The drain grate system 10" can include a grate 52" configured to allow the flow of a liquid therethrough and to block passage of debris therethrough. Several features of the grate 52", as illustrated in FIG. 9, can significantly improve performance when compared to other drain grate systems. Though certain benefits are highlighted herein, it will be understood that various features of the drain grate system 10" can be combined with other embodiments, and other drain grate systems to provide a system with additional and/or other strengths and weaknesses that may be desirable in certain situations.

Figure 10:
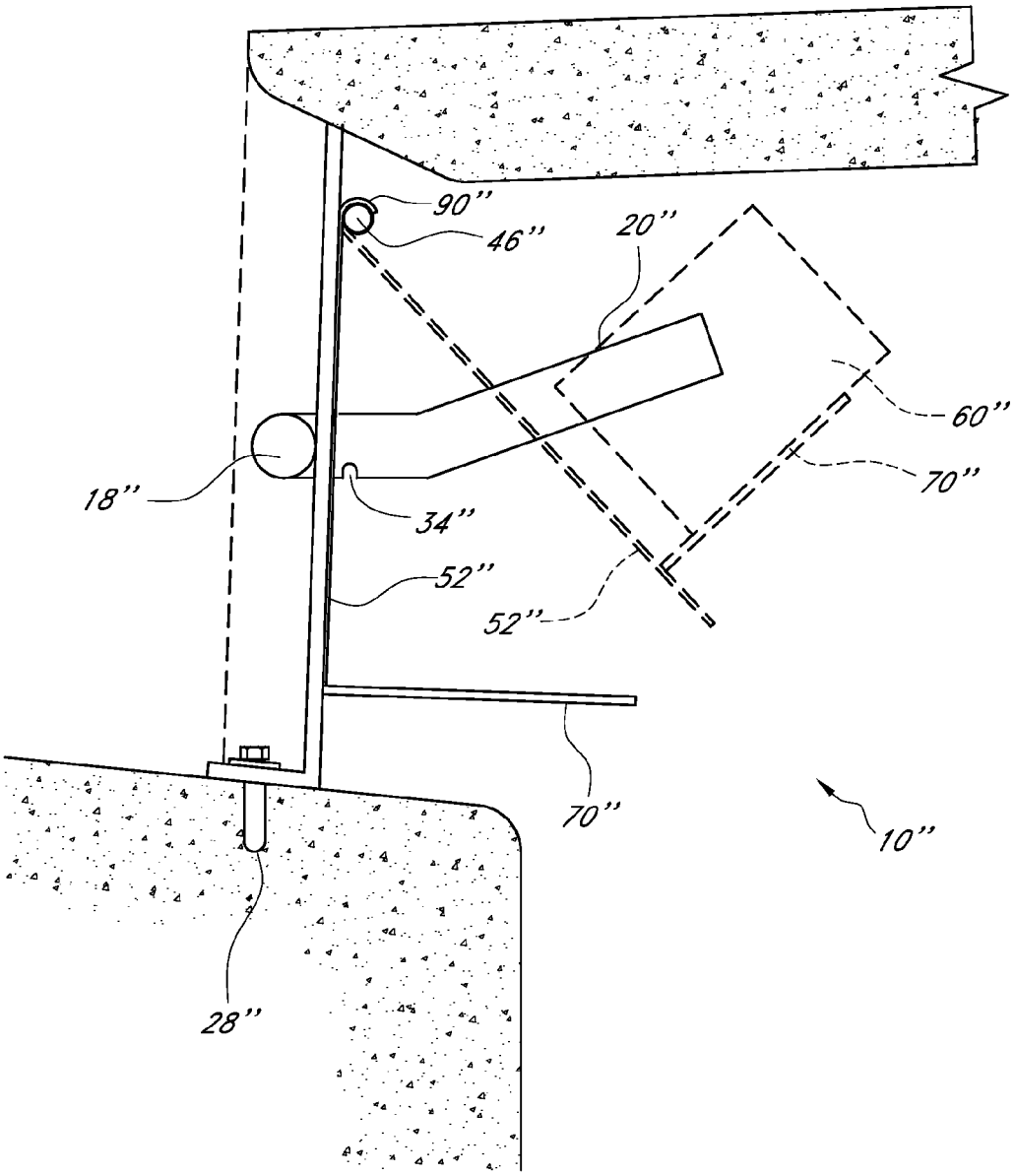
FIG. 10 illustrates a side view of the drain grate system of FIG. 9.

In one embodiment, as illustrated in FIG. 9, the grate 52" includes a bend 90" along the top edge of the grate 52". The bend 90" can be a curve. For example, the entire top of the grate, or a substantially portion thereof, can be curved to form a round top to the grate. The bend 90" can be integrally formed in the grate 52". The bend 90" can both support the weight of the drain grate system 10" and allow the grate 52" to rotate about axles 46" as shown in FIG. 10. The axles 46" can be connected to the grate, such as by welding, or the grate may sit on and/or surround the axles with the bend 90". The axle may be connected to or pivotally connected to a leg similar to the legs 40, 40' previously described. In this way the grate can rotate about or with the axles 46". The drain grate system 10" can include an outer frame that may include a fixed protective bar and legs, such as that shown in FIG. 5A. In some embodiments the outer frame may also include a top plate such as that shown in FIG. 5. It will be understood that the outer frame may not include a top plate, and may have other configurations than those shown.

As illustrated in FIGS. 9 and 10, the bend 90" may be shaped and sized to complement that of the axles 46". In some embodiments, the bend 90" at the top of the grate 52" may be circular in shape. In other embodiments the top of the grate 52" may comprise multiple bends. In some embodiments the top of the grate may be bent to form a square shaped channel in which the axles 46" may be inserted.

Integrally forming the bend 90" into the grate 52" beneficially reduces the number of parts in the drain grate system 10", reducing both the cost of material as well as the cost of assembly.

In some embodiments, the grate 52" can be sufficiently rigid so as to not require any additional frame or supporting pieces, such as a surrounding frame. For example, the grate can comprise a single sheet of material without a supporting frame integrally coupled to the grate. The grate 52" can be rigid enough so that it is capable of supporting itself, significantly improving performance over other drain grate systems. By alleviating the need for additional framework or support plates, the grate 52" has few parts, and is easier to manufacture, thereby reducing cost and assembly time.

In some embodiments, the grate 52" may comprise a plate with a plurality of apertures 85" formed therethrough to form a screen allowing the flow of liquid therethrough but blocking the passage of debris. The plate is preferably made of steel but can also be made of other materials. In one embodiment the apertures 85" may be circular in shape, while in other embodiments the apertures may have a non-circular shape. Some example shapes include circles, ovals, squares, polygons, diamonds, or any other shape. The size, shape and/or pattern of the apertures 85" may or may not be consistent throughout the grate. The size, shape, and/or pattern of the apertures 85" may be based at least partially upon the required rate of flow, the potential size of debris, as well as the manufacturing methods used to produce the apertures 85". In one embodiment, the apertures may be larger in size directly adjacent the force plates 60" in order to maximize the flow which reaches the force plate and facilitate more responsive opening of the drain grate system 10" during storm water events.

In some embodiments, the grate can have a greater amount of surface area that is solid verses the area with holes or flowthrough area. For example, the grate can have 50%, 40%, 30%, or less of the total surface area covered with holes. As one example, if the grate were divided into standard units, every 2 square units could include a circle shaped hole with a 1 unit diameter. This would provide a grate having holes on a little less than about 40% of the total surface area of the plate. Thus, in some embodiments, the surface solid area on the face of the grate can be greater than the surface area of the holes on the face of the grate. Even with a greater amount of solid verse openings the grate can still provide sufficient flowthrough while blocking more debris. In addition, the greater solid surface area can allow the grate to open to a greater extent, allowing more water to flow through the system, then would be possible otherwise, such as during a flooding event. The increased surface area may allow the grate 52" to open further when it is in an unlocked position, maximizing flow during a storm water event. In a preferred embodiment, the apertures 85" may be 0.75 inches in diameter. In other embodiments, they may be somewhere between about 0.25 inch to about 1 inch in diameter.

The increased surface area can also help to increase the structural rigidity of the grate. For example, in some embodiments, the rigidity may be increased without having to increase the thickness of the metal material used to form the grate.

Referring back to FIG. 9, the grate 52" is also shown having pivots 67". A pivot 67" can be used to couple a latch member 32" to the grate. As has been discussed previously with respect to other embodiments, applying a force on the force plate 60" can cause the latch member 32" to rotate at the pivot 67" to disengage the latch member 32" from the recess 34" in the arm. Once the latch member 32" is released from the arm 20", the grate 52" can pivot moving towards an open position.

The pivot 67" can include a pivot rod, a pivot disk and rotating portion. It may also include, or the above parts may be, washers, spacers, etc. The rotating portion can be attached to, and/or part of the latch member 32". The rotating portion can rotate about the pivot rod. In some embodiments, the pivot rod can attached to the pivot plate which is then attached to the grate. The pivot plate can be secured with a fastener, or may be welded to the grate. In some embodiments, the pivot rod can also double as a fastener.

In some embodiments, as illustrated in FIG. 9, the pivot 67" may mount directly to the grate 52". In some embodiments, the pivot 67" may be removably engaged to the grate so that the pivot can be replaced in the field as necessary. The pivot may be attached through the use of a fastener or a weld.

Figure 11:
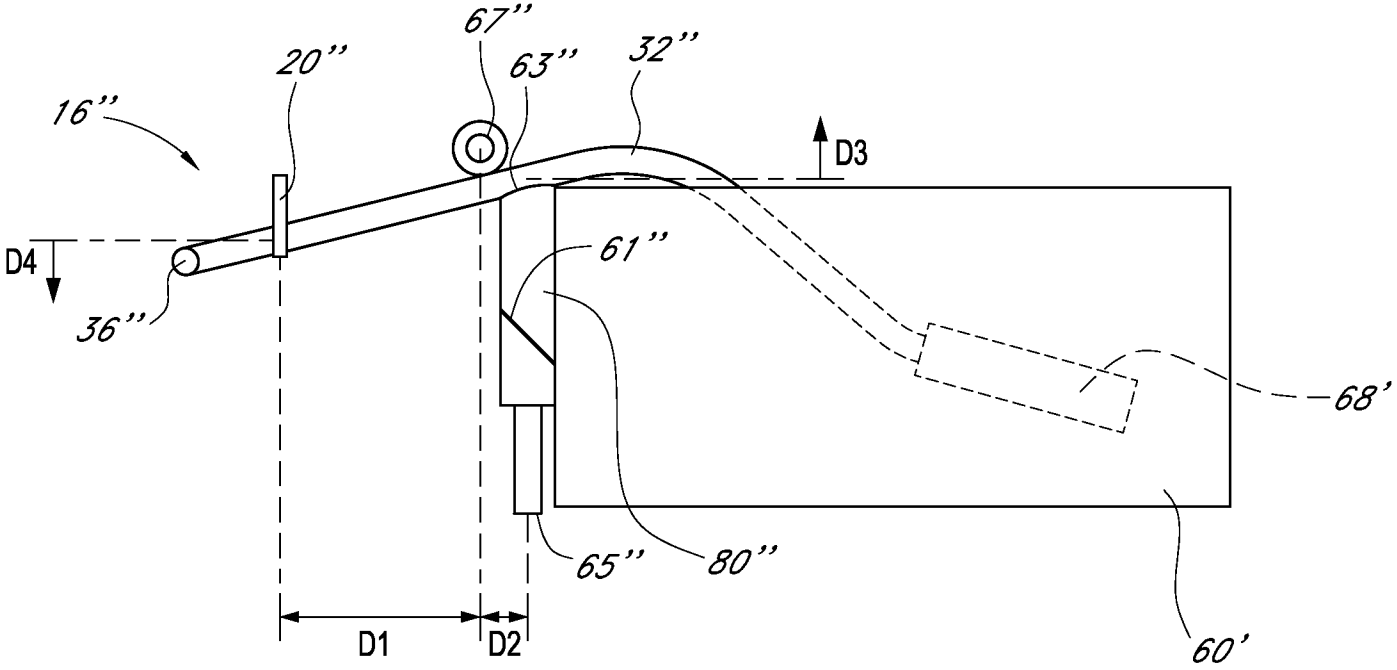
FIG. 11 illustrates a rear detail view of the drain grate system of FIG. 9 showing a self locking mechanism.

Referring now to FIGS. 9 and 11, the locking mechanism 16" is further described. A storm drain grate locking mechanism 16" can comprise an arm 20", a hinged actuation member 80" configured to open a locking mechanism 16" and latch member 32" engaged with the arm 20" when the locking mechanism 16" is in a locked position, the latch member 32" configured to rotate about a pivot 67". Rotating the actuation member 80" about a cam interface 61" can cause the actuation member 80", which is integrally connected to the force plate 60", to rotate about an axis while at the same time moving along the axis, the axial displacement causing the latch member 32" to rotate and disengage from the arm 20", moving the locking mechanism 16" to an unlocked position. The storm drain grate locking mechanism 16" of some embodiments can further comprise a second cam interface 63" configured to increase the displacement of the latch member 32" to thereby increase the amount of rotation experienced by the latch member 32".

The push member 33" (FIG. 9) can comprise a similar arrangement as the latch member 32", however instead of engaging the arm 20" directly, the push member 33" can engage the latch member 32", disengaging the latch member 32" from the arm 20", and unlocking the locking mechanism 16".

The illustrated locking mechanism 16" can impart greater control on the opening and closing of the drain grate system 10". For example, with the locking mechanism 16", a drain grate system 10" can be more easily adjusted to allow, for example, greater control on the minimum flow required to unlock the locking mechanism 16" and to fully open the grate.

As one example, the drain grate system 10", when compared to other drain grate systems, by reducing the amount of deflection of the force plate 60" necessary to unlock the locking mechanism 16" and allow the grate 52" to rotate.

As illustrated in FIG. 11, the amount of vertical displacement D3 of the latch member 32" adjacent the actuation member 80" necessary to displace the latch member 32" from the recess 34" of the arm 20" and unlock the locking mechanism 16" can be varied by changing the distances between the arm 20", the pivot 67", and the actuation member 80", among other things. The horizontal distance between the arm 20" and the pivot 67" is represented by D1, and the horizontal distance between the pivot 67" and the second cam interface 63" is represented by D2. In a preferred embodiment, the upward vertical displacement D3 of the latch member 32" adjacent the actuation member 80" is less than the downward vertical displacement D4 of the latch member adjacent the arm 20". In other words, a small movement D3 at the interface 63" can cause a larger movement D4 of the latch member 32" at the arm 20". For example, the displacement D3 can be less than 75% of the displacement D4. In another embodiment, the displacement D3 can be less than 50% of the displacement D4. In other embodiments, the displacement D3 may be between 75% and 5% of the displacement D4. The smaller displacement D3 verses D4 can beneficially allow the grate to open in a more repeatable and reliable manner.

As shown, D1 illustrates the distance between the pivot 67" and the arm 20", while D2 illustrates the distance between the pivot and the interface 63". To facilitate the above differences in displacement between D3 and D4, the distance D2 can be between about 2 to 8 times the distance D1. In other examples, the distance D2 can be between about 3 to 6, or 4 to 5 times the distance D1. In other examples, the distance D2 can be about 3, 3.5, 4, 4.5, 5, 5.5, or 6 times the distance D1.

In the embodiment, as illustrated in FIG. 11, the vertical displacement D3 of the latch member 32" adjacent the actuation member 80" is approximately 22% of the vertical displacement D4 of the latch member 32" adjacent the arm 20". This improved arrangement of the locking mechanism significantly reduces the vertical displacement D3 of the force plate 60" and actuation member 80" necessary to unlock the locking mechanism 16", thus significantly reducing the rotational range of movement of the force plate 60" necessary to unlock the locking mechanism 16", thereby facilitating more responsive opening of the drain grate system 10" during storm water events.

In some embodiments, the locations of the arm 20", the pivot 67", and the actuation member 80" may be different depending on the requirements of the particular application. In some embodiments the locking mechanism may take on an alternative configuration. For example, the latch member may reside in a recess on the top portion of the arm and the pivot point may be further from the arm then the actuation member. In some embodiments, the cam interface 63" may not be shaped like a cam; instead it may comprise a flat surface on the top of the actuation member. In some embodiments, the latch member and/or the push member may not require a counterweight depending on the configuration of the locking mechanism, reducing cost of manufacture and weight of the drain grate system.

As shown in FIG. 9, some embodiments of drain grate system 10" may include a counterweight 68" on the latch member 32", but may not have a counterweight on the push member 33". The improved mechanical advantage of the drain grate system 10" can allow the system to rely on a single counterweight, though if desired, the system may still include additional counterweights. In addition, the weight of the counterweight 68" can be used to control the amount of force necessary to open the system. With a large mechanical advantage, and a small amount of rotation required to advance the force plates to unlock the locking mechanism, the weight of the counterweight can be used to control the force of the water necessary to open the grate. This can allow for more precise and better control of the system, as well as providing a more reliable and repeatable assembly.

The locking mechanism 16" can facilitate more responsive opening of the drain grate system 10" during storm water events. Responsive opening of the drain grate system 10" can be an important consideration in regards to maximizing the amount of water which the grate can pass during a storm water event, reducing flooding in the surrounding area.

Figure 12:
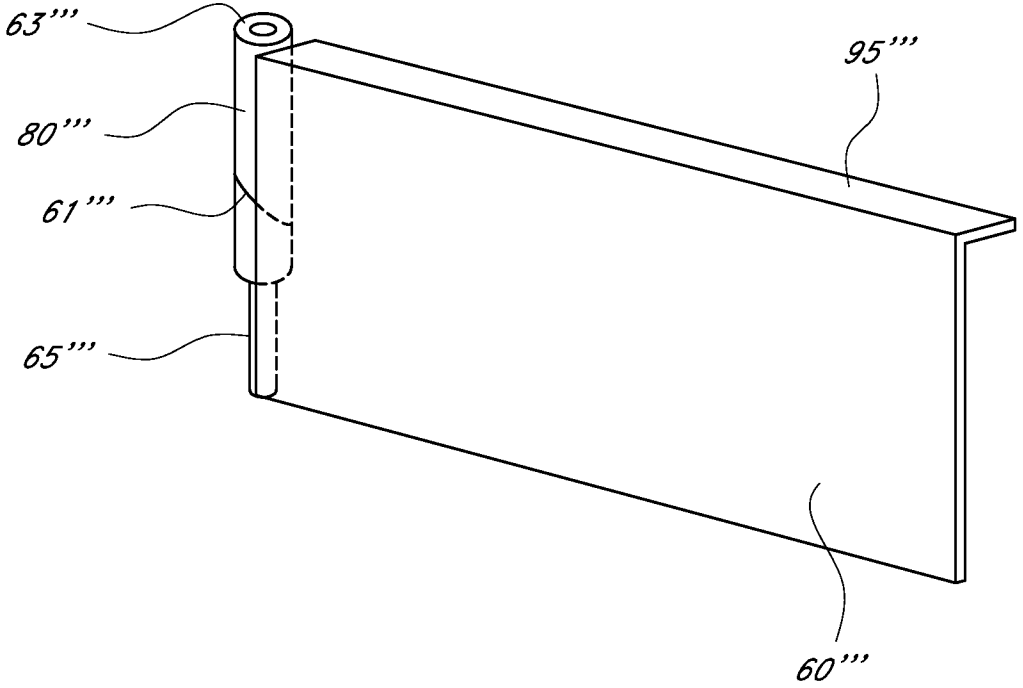
FIG. 12 illustrates a rear perspective detail view of another embodiment of a force plate.

As illustrated in FIG. 12, in some embodiments the force plate 60'" may include a bend 95'" along the top portion of the force plate 60'". The bend 95'" comprises a bend of the force plate 60'" towards the grate 10" and can prevents some of the water from cascading over the top of the force plate 60'". In some embodiments, the force plate may incorporate the bend 95'" on the top portion of the force plate as illustrated in FIG. 12 as well the bend at the end of the force plate as previously discussed. Thus, the force plate can have a top portion extending substantially perpendicularly from a main portion of the force plate and towards the grate. The bends can reduce the rate of water flow required to unlock the locking mechanism 16" and can help maintain the system in an open position by redirecting the water flow and capturing more of the storm water energy, and translating that energy into movement against the force plate 60'". The bends also increase the strength of the force plate 60'", improving structural rigidity and allowing the use of thinner gauge material in the force plate's construction.

In addition to those discussed above, the drain grate system 10" has many benefits. For example, the only components on the sides of the drain can be the hinges about which the grate 52" rotates. The moving components of the locking mechanism 16" are attached to the grate 52" and remain protected behind the grate 52" from large debris. Many of the currently available systems other than the drain grate system 10" have components to the sides of the grate. Once the grate is opened on these other drain grate systems the side components can be subject to the flow of debris such as leaves, sticks, litter, etc. This debris can interfere with or hinder the proper functioning of these other drain grate systems. For example, leaves or sticks can get stuck in these locking mechanisms on the sides. This can cause the system to not be able to lock or shut fully after the flow of liquid has subsided. This design also subjects the working parts of the drain grate system to the most abuse as debris flows directly at, around and through the sides of the drain opening. As discussed above, the drain grate system 10" does not suffer from these problems as the locking mechanism 16" is protected by and moves with the grate 52".

Beneficially, the disclosed embodiments can all be installed at the drain opening and do not require other interior assemblies to be installed within the drain. The various systems for locking and opening the grate are fairly small compared to the prior art and require only a small amount of displacement which allows them to be used in most drain sizes. Thus a city or county can install one type of drain grate system throughout the city or county which has the potential to save costs in maintaining and installing the systems. In addition, there are no small moving parts or tight tolerances. This allows the disclosed embodiments to take a large amount of wear and tear without the need for maintenance which is an important consideration to cities and counties purchasing these units. In particular, in the illustrated embodiments there are no biasing springs which can break or can malfunction due to debris interfering with their operation or can fail due to stress over time.

Another benefit of the disclosed embodiments is that as long as there is a sufficient flow into the drain the drain grate system can remain open. This can be true even if the drain is essentially flooded. There are no hanging buckets or troughs which require the weight of a liquid to press downward on them so that the grate will remain open. Rather, in the disclosed embodiments the force of the flow into the drain can keep the grate open.

Further, eliminating the need or decreasing the size of certain fixtures, support frames, support plates, etc., and increasing the structural rigidity of the grate 52", as discussed herein can vastly improve operation of the drain grate system 10". In addition, the decreased quantity of components and decreased assembly time drastically reduce the cost of manufacture.

In some embodiments, the lack of a supporting frame and support plates can significantly decrease the weight of the drain grate system 10", providing easier installation of the drain grate system 10", and reducing the force necessary to open the grate 52" once the locking mechanism 16" has been unlocked. The decreased weight of the grate 10" along with the decreased weight of the locking mechanism 16", force plates 60" and/or energy plates 70" can facilitate more responsive opening of the grate during storm water events and can allow the grate to open further while maximizing the flow rate through the drain grate system 10". Testing has shown that the bottom of the grate on the drain grate system 10" as illustrated in FIG. 9 opens approximately 3 inches during a simulated storm water event, while previous embodiments were only able to open approximately 1.5 inches.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Further, the various features of this invention can be used alone, or in combination with other features of this invention other than as expressly described above. Thus, it is intended that the scope of the present invention herein disclosed should not be limited by the particular disclosed embodiments described above, but should be determined only by a fair reading of claims presented in a non-provisional application based hereon.

What is claimed is:

1. A drain grate system for positioning at a drain and to control fluid flow into the drain, the drain grate system comprising:

a frame configured to be fixed in position with relation to a drain;

at least one axle;

a grate having a curved top, the grate pivotally coupled to the frame through the at least one axle at the curved top, the grate configured to filter flows of liquid therethrough and to pivot between a closed position and an open position;

a locking mechanism biased to lock the grate in the closed position, the locking mechanism comprising:

a force plate coupled to the grate and configured such that a flow of liquid acting upon the force plate causes a portion of the force plate to move away from the grate thereby unlocking the grate and allowing the grate to move to the open position, wherein the force plate comprises:

a continuous surface defining a main portion, the continuous surface extending from a first side coupled to the grate to an open second side; and a secondary portion positioned on a top of the main portion and extending substantially perpendicularly from the main portion and towards the grate.

2. The drain grate system of claim 1, wherein a face of the grate comprises a flowthrough area of less than 50% of the entire surface area of the face of the grate.

3. The drain grate system of claim 2, wherein the grate comprises a single sheet of material without a supporting frame forming part of the grate.

4. The drain grate system of claim 1, wherein the grate comprises a single sheet of material without a supporting frame forming part of the grate.

5. The drain grate system of claim 1, wherein the grate comprises a single sheet of material without a supporting frame coupled with and surrounding the grate.

6. The drain grate system of claim 1, wherein the frame comprises a bar coupled to two side legs.

7. A storm drain grate system comprising:

a grate configured to filter flows of liquid therethrough and to pivot between a closed position and an open position;

a locking mechanism having a locked position and an unlocked position, the locking mechanism being biased to the locked position when the grate is in the closed position, the locking mechanism comprising:

a fixed arm comprising a recess;

a latch member having a first portion engaged with the fixed arm when the locking mechanism is in a locked position, the latch member further having a second portion and the latch member configured to rotate;

a pivot coupled to the latch member;

a force plate configured such that a flow of liquid acting upon the force plate causes the force plate to rotate, the second portion of the latch member engaged with the force plate and configured such that rotation of the force plate causes rotation of the latch member to thereby disengage from the fixed arm and to move the locking mechanism to the unlocked position;

wherein the latch member is configured such that rotation of the latch member between the locked and unlocked positions causes the second portion of the latch member engaged with the force plate to move a first distance less than 75% of a second distance experienced by the first portion of the latch member and wherein a third distance between the pivot and the recess in the arm is greater than a fourth distance between the pivot and where the second portion of the latch member engages with the force plate.

8. The drain grate system of claim 7, wherein the third distance is between about 2 to 8 times the fourth distance.

9. The drain grate system of claim 7, wherein the grate has a curved top.

10. The drain grate system of claim 9, further comprising a frame configured to be fixed in position with relation to a drain and at least one axle, the grate pivotally coupled to the frame through the at least one axle at the curved top of the grate.

11. The drain grate system of claim 7, wherein the first distance is less than 50% of the second distance.

* * * * *